US006474227B2

(12) United States Patent
Narita

(10) Patent No.: US 6,474,227 B2
(45) Date of Patent: Nov. 5, 2002

(54) METHOD OF CONTROLLING SYNCHRONOUS DRIVE OF PRESSING MACHINE AND PRESSING MACHINE USABLE IN THE METHOD

(75) Inventor: Shinichi Narita, Sagamihara (JP)

(73) Assignee: Aida Engineering, Ltd., Kanagawa (JP)

( * ) Notice: Subject to any disclaimer, the term of this patent is extended or adjusted under 35 U.S.C. 154(b) by 148 days.

(21) Appl. No.: 09/754,408

(22) Filed: Jan. 3, 2001

(65) Prior Publication Data

US 2001/0032550 A1 Oct. 25, 2001

(30) Foreign Application Priority Data

Apr. 24, 2000 (JP) ..... 2000-122935
Apr. 24, 2000 (JP) ..... 2000-122936
Apr. 24, 2000 (JP) ..... 2000-122937

(51) Int. Cl.[7] ..... B30B 13/00

(52) U.S. Cl. ..... 100/35; 100/280; 100/282; 72/20.4; 72/21.1

(58) Field of Search ..... 100/35, 282, 280, 100/297; 74/64, 339, 44; 192/48.2, 48.9; 72/429, 452.9, 12.3; 318/85, 625

(56) References Cited

U.S. PATENT DOCUMENTS 3,858,432 A * 1/1975 Voorhees et al. ..... 72/455
4,307,591 A * 12/1981 Peterson ..... 72/21.1
5,009,091 A * 4/1991 Hinterman et al. ..... 72/21.1
5,468,194 A * 11/1995 Hayashi ..... 100/280
5,852,970 A * 12/1998 Bornhorst et al. ..... 100/282 X
5,952,808 A * 9/1999 Umeji

* cited by examiner

*Primary Examiner*—W. Donald Bray
(74) *Attorney, Agent, or Firm*—David L. Hoffman, Esq.; Cislo & Thomas LLP

(57) ABSTRACT

With a method of controlling synchronous drive of a plurality of pressing machines, each of the pressing machines has a motor, a drive shaft to which a torque of a flywheel driven by the motor is transmitted through a clutch and a slide driven by the drive shaft so that a rotational position of the drive shaft of each of the pressing machines is synchronous each other. The method has a step of detecting actual velocity information of the motor and a step of detecting actual rotational-position information of the drive shaft. The detected actual rotational-position information is compared with the reference rotational-position information from a reference rotational position information generating section. Based on the result of the comparison, the reference velocity information from a reference velocity information generating section is compensated into characteristic reference velocity information of each of the pressing machines. The motor is controllably driven based on the characteristic reference velocity information and the actual velocity information.

33 Claims, 12 Drawing Sheets

METHOD OF CONTROLLING SYNCHRONOUS DRIVE OF PRESSING MACHINE AND PRESSING MACHINE USABLE IN THE METHOD

BACKGROUND OF THE INVENTION

1. Field of the Invention

The present invention relates to a method of controlling synchronous drive of a plurality of pressing machines so that a position of a slide of each of the pressing machines is synchronous each other and a pressing machine usable in such a method.

The present invention also relates to a method of controlling synchronous drive of a plurality of pressing machines so that a position of a slide of each of the pressing machines is synchronous each other with a predetermined phase difference and a pressing machine usable in such a method.

2. Description of the Related Art

It has been attempted to synchronously drive a plurality of pressing machines, for example, with zero phase difference. In such a case, the output of a motor is first transmitted to the flywheel of a pressing machine, the rotational power being then transmitted to the drive shaft of the pressing machine through a clutch. The drive shaft may be in the form of a crankshaft for driving a slide (or ram). Thus, the stamping die of the pressing machine can be driven.

In the conventional phase synchronization, one of the pressing machines is used as a master machine while the other pressing machines are used as slave machines. Such a control is called "master/slave system".

In the prior art, the master machine controlled the velocity of the motor thereof by comparing the encode output of the motor with reference velocity information and using the difference therebetween so that the motor will be rotated with the reference velocity. In other words, the master machine did not perform the control which is based on the positional information of the crankshaft.

On the other hand, the slave machines compensatively controlled the positions thereof, based on the positional information of the crankshaft in the master machine so that the slave machines will match the master machine in phase. More particularly, an encoder was provided on each of the crankshafts to take the positional information of the rotating crankshafts in the master and slave machines. The motor of each of the slave machines was controlled to cancel the difference between the crankshaft position of the master machine and the crankshaft position of each of the slave machines.

The pressing machines may synchronously be driven with a predetermined phase difference. In this case, the motor in each of the slave machines may be controlled to create a predetermined phase difference between the crankshaft position of the master machine and the crankshaft position of each of the slave machines.

However, it is actually difficult to provide a phase difference between the master and slave machines since the rotational-position information of the master machine depends on the reference position information of the slave machines. In the first place, the prior art did not have the technical concept of phase-difference synchronous operation.

In the synchronous control mentioned above, the motor control in the slave machines will adversely be affected by any disturbance such as a load change characteristic of the master machine due to the energy released from the flywheel of the master machine on pressing. In a pressing machine having an increased load inertia, thus, it is difficult to provide an highly accurate synchronization.

In the prior art, thus, the master machine is in its characteristic driving state while the slave machines must forcibly be matched to the master machine in phase. Even though the synchronization between the master and slave machines is controlled by such a method, excessive load will be exerted to the slave machines when they are controlled in the presence of the disturbance from the master machine. This unnecessarily changes the velocity in each slave machine and degrades the accuracy in synchronization.

When the master and slave machines are to run synchronously, it is preferred that the crankshafts thereof are synchronized in phase immediately after clutch engagement.

In the prior art, thus, the crankshafts in all the pressing machines must have been stopped in a certain narrow range of angle before clutch engagement. However, such a procedure is complicated.

When the master and slave machines are to run synchronously, it is also preferred that the crankshafts thereof are synchronized with any phase difference immediately after clutch engagement.

On the other hand, when the master and slave machines are to run synchronously with phase difference, it is further preferred that the crankshafts thereof are synchronized while maintaining any phase difference therebetween, immediately after clutch engagement.

In the prior art, thus, the crankshafts of all the pressing machines must have been stopped while being aligned with one another before the clutch engagement. Alternatively, when it is required to provide a predetermined phase difference between the master and slave machines, each of the crankshafts must have been stopped with a predetermined angle corresponding to that phase difference. However, such a procedure is complicated.

When the pressing machines are synchronously running with zero phase difference, this restricts the operating cycle time for a supply device which supplies materials to the pressing machines or a delivery device which delivers products between the pressing machines. Thus, such peripheral devices have executed and been completed in operation within a limited short time period. This provides a severe limitation to the peripheral devices, leading to reduction of the maximum velocity of production in the entire press line.

SUMMARY OF THE INVENTION

It is thus an objective of the present invention to provide a method of controlling synchronous drive of a plurality of pressing machines with zero phase difference or any phase difference, which can realize an improved accuracy of synchronization without adverse affection of a load change in any one pressing machine to the remaining pressing machines as a disturbance, and to provide a pressing machine usable in such a method.

Another objective of the present invention is to provide a method of controlling synchronous drive of a plurality of pressing machines, which can effectively drive the pressing machines and avoid any overload to the pressing machines due to a transitional increase of control by reducing the positional control rate between the pressing machines immediately after clutch engagement to relieve the load on the motors, and to provide a pressing machine usable in such a method.

Still another objective of the present invention is provide a method of controlling synchronous drive of a plurality of pressing machines, which can reduce the control of the positions between the pressing machines immediately after the clutch engagement to relief the load on the motors and to avoid any increased transitional control, which can initiate the control of synchronization relating to a predetermined phase difference immediately after the pressing machines have been started with the same angle of stoppage and which can set and change the phase difference even during operation under load, and to provide a pressing machine usable in such a method.

A further objective of the present invention is to synchronously drive a plurality of pressing machines intentionally with a phase difference therebetween to extend the operating cycle time for the peripheral devices, to relieve the limitation applied to the peripheral devices and to increase the maximum velocity of production.

A further objective of the present invention is to provide a method of controlling synchronous drive of a plurality of pressing machines, in which the pressing machines will not adversely be affected by any disturbance due to a load change in any one of the pressing machines and can quickly and accurately respond to a command of motor speed change, irrespective of the engagement/de-engagement of clutch, and to provide a pressing machine usable in such a method.

A further objective of the present invention is to provide a method of controlling synchronous drive of a plurality of pressing machines, which can fully use the torque power of the motors to accelerate/decelerate the flywheels, thereby reducing time required to accelerate/decelerate the flywheels, and set-up time and waiting time, and to provide a pressing machine usable in such a method.

A further objective of the present invention is to provide a method of controlling synchronous drive of pressing machines, which can extend time required for accelerating/decelerating the pressing machine to suppress the accelerating/decelerating torques of the motors on clutch engagement, thereby changing the run velocity while maintaining the restoring function as well as the accuracy of synchronous control after the energy of the flywheels has been released on pressing, and to provide a pressing machines usable in such a method.

A further objective of the present invention is to provide a method of controlling synchronous drive of pressing machines, which does not require to maintain the clutch-off state until the flywheels reach the constant speed after the velocity has been changed, thereby enlarging the degree of freedom in the operational ability and which can further avoid any overload on the motors to drive the pressing machines more effectively, and to provide a pressing machine usable in such a method.

According to a first aspect of the present invention, it provides a method of controlling synchronous drive of a plurality of pressing machines, each of the pressing machines having a motor, a drive shaft to which a torque of a flywheel driven by the motor is transmitted through a clutch and a slide driven by the drive shaft so that a rotational position of the drive shaft of each of the pressing machines is synchronous each other, the method comprising:

a first step of setting reference velocity information of each of the motors in the pressing machines;

a second step of generating reference rotational-position information of each of the drive shafts, based on the reference velocity information;

a third step of engaging the clutch of each of the pressing machines; and a fourth step of controlling drive of the motor in each of the pressing machines, wherein the fourth step carried out in each of the pressing machines comprising the steps of:

detecting actual velocity information of the motor;

detecting actual rotational-position information of the drive shaft;

comparing the actual rotational-position information with the reference rotational-position information;

compensating the reference velocity information into characteristic reference velocity information of each of the pressing machines, based on a result of the comparison; and controlling drive of the motor, based on the characteristic reference velocity information and the actual velocity information.

According to the first aspect of the present invention, the reference velocity information is set for the motor of each of the pressing machines and then used to generate the reference position information of the drive shaft of each of the pressing machines. Each reference position information is used as a virtual master signal which will not adversely be affected by the load change in either of the pressing machines. There is then determined a difference (or error) between the actual rotational-position information and the reference position information of each of the crankshafts. Such a difference is used to compensate a preset reference velocity information to determine the reference velocity information characteristic of each of the pressing machines. The motors of the pressing machines can synchronously be driven and controlled with increased accuracy, based on the reference velocity information characteristic of the respective pressing machines and the actual velocity information of the respective pressing machines.

The reference velocity information may be set in common of the motors in the pressing machines.

The first aspect of the present invention may include a step of compensating a rate of the velocity change so as to alleviate the velocity change rate, when the reference velocity information includes a velocity change. For example, even though the velocity is to be stepwise changed, the motor cannot follow the stepwise change of velocity. This causes the overload on the motor while the mechanical stress is also applied to the mechanical driving mechanism. When the speed velocity is alleviated, the motor can be driven within its rating. This provides smoother acceleration/deceleration.

The fourth step may further comprise a step of compensating the reference rotational-position information within a predetermined time period immediately after the clutch of each of the pressing machines is engaged, based on an engagement property of the clutch, which is characteristic of each of the pressing machines. Thus, the position of each of the drive shafts can smoothly be controlled immediately after clutch-on.

The third step may further comprises:

a step of detecting stoppage angle information of the drive shaft of each of the pressing machines before the clutch of each of the pressing machines is engaged; and a step of determining an engagement sequence of the clutch of each of the pressing machines, based on the stoppage angle information of the drive shaft of each of the pressing machines, and the engagement sequence may be determined so that the clutch of at least one of the pressing machines having a stoppage angle position of the drive shaft which is more delayed in the rotational angle of the drive shaft is engaged earlier.

Thus, the control of synchronous drive can be realized without the drive shafts of the pressing machines being stopped being aligned with a certain angle.

At this time, a clutch of one of the pressing machines may be engaged earlier than a clutch of another of the pressing machines in the third step, and a timing of clutch engagement of the other of the pressing machines may be determined based on an engagement property of the clutch of the other of the pressing machines and an actual velocity of the drive shaft of the one of the pressing machines. This is because there can be detected at which angle in the drive shaft of the one of the pressing machines with the clutch thereof being precedingly engaged, the clutch in the other of the pressing machines should be engaged, based on the engagement property of the clutch in the other of the pressing machines as well as the actual velocity of the drive shaft in the one of the pressing machines.

One technique of determining the timing of clutch engagement may be that the timing of clutch engagement in the other of the pressing machines is determined according to information obtained by time integrating the actual velocity, through time required for a velocity equal to the actual velocity of the drive shaft of the one of the pressing machines is obtained by the other of the pressing machines, based on the engagement property of the clutch after the clutch of the other of the pressing machines has been engaged.

According to a second aspect of the present invention, it provides a pressing machine comprising:

a motor;

a clutch which intermittently transmits a torque of a flywheel driven by the motor to the pressing machine;

a drive shaft which drives a slide by a power transmitted through the clutch;

first detection device which detects actual velocity information of the motor;

second detection device which detects actual rotational-position information of the drive shaft;

first generating device which generates reference velocity information of the motor;

second generating device which generates reference rotational-position information of the drive shaft, based on the reference velocity information;

compensation device which compensates the reference velocity information at a time of engagement of the clutch, based on a difference between the actual rotational-position information and the reference rotational-position information; and a motor drive controlling circuit which controls drive of the motor, based on the actual velocity information and the reference velocity information when the clutch is de-engaged, and based on the actual velocity information and the reference velocity information compensated by the compensation device when the clutch is engaged.

Such a pressing machine may be used to carry out the aforementioned method of controlling synchronous drive of a plurality of pressing machines according to the present invention in an optimal manner.

The first generating device may include a first compensation block which compensates so as to alleviate a velocity change rate when the reference velocity information includes the velocity change. This is because the motor can be prevented from being overloaded by driving the motor within its rating, as described.

The second generating device may include a second compensation block which compensates the reference rotational-position information within a predetermined time period immediately after the clutch is engaged, based on an engagement property of the clutch. The drive control, thus can be carried out smoothly after the clutch engagement, too.

Moreover, the second generating device may include:

a first generating block which generates unit-rotational-position information of the drive shaft per predetermined unit time, based on the reference velocity information from the first generating device; and a second generating block which generates reference rotational-position information by integrating the unit-rotational-position information per predetermined time period.

According to a third aspect of the present invention, it provides a method of controlling synchronous drive of a plurality of pressing machines, each of the pressing machines having a motor, a drive shaft to which a torque output of a flywheel driven by the motor is transmitted through a clutch and a slide driven by the drive shaft so that a rotational position of the drive shaft of each of the pressing machines has phase difference from each other, the method comprising:

a first step of setting reference velocity information of each of the motors in the pressing machines;

a second step of generating reference rotational-position information of each of the drive shafts, based on the reference velocity information;

a third step of setting a phase difference with respect to the reference rotational-position information of at least one of the pressing machines;

a fourth step of engaging the clutch of each of the pressing machines; and a fifth step of controlling drive of the motor in each of the pressing machines, wherein the fifth step carried out in each of the pressing machines comprises the steps of:

detecting actual velocity information of the motor;

detecting actual rotational-position information of the drive shaft;

comparing the actual rotational-position information with the reference rotational-position information;

compensating the reference velocity information into characteristic reference velocity information of each of the pressing machines, based on a result of the comparison; and controlling drive of the motor, based on the characteristic reference velocity information and the actual velocity information, and wherein the fifth step carried out in the at least one of the pressing machines to which the phase difference is set, further comprises a step of phase-shifting the reference rotational-position information by the phase difference set in the third step, and the phase-shifted reference rotational-position information and the actual rotational-position information are compared in the comparing step.

In addition to the aforementioned functions, such an arrangement is to phase-shift the reference rotational-position information by the phase difference set for at least one of the pressing machines. When the synchronization is controlled based on the result of comparison between the phase-shifted reference rotational-position information and the actual rotational-position information, the control of synchronization can accurately be realized while maintaining the phase differences.

The fifth step may be carried out in the at least one of the pressing machines to which the phase difference is set includes a step of setting a rate of gradually applying the phase difference. Thus, the phase difference may be changed during operation of that pressing machine by gently changing the phase difference in such a manner.

The third step may further comprise:

a step of detecting stoppage angle information of the drive shaft of each of the pressing machines before the clutch of each of the pressing machines is engaged; and a step of determining an engagement sequence of the clutch of each of the pressing machines, based on the stoppage angle information of the drive shaft of each of the pressing machines and based on the phase difference.

In such a manner, the control of synchronous drive can be initiated while maintaining the phase difference, even though the drive shaft in each of the pressing machines synchronously driven with a phase difference has been stopped with that phase difference.

According to a fourth aspect of the present invention, it provides a pressing machine comprising:

a motor;

a clutch which intermittently transmits a torque output of a flywheel driven by the motor to the pressing machine;

a drive shaft which drives a slide by a power transmitted through the clutch;

first detection device which detects actual velocity information of the motor;

second detection device which detects actual rotational-position information of the drive shaft;

first generating device which generates reference velocity information of the motor;

second generating device which generates reference rotational-position information of the drive shaft, based on the reference velocity information;

phase difference setting device which sets a phase difference to the reference velocity information;

compensation device which compensates the reference velocity information at a time of engagement of the clutch, based on a difference between the actual rotational-position information and the reference rotational-position information to which the phase difference is set; and a motor drive controlling circuit which controls drive of the motor, based on the actual velocity information of the motor and the reference velocity information when the clutch is de-engaged, and based on the actual velocity information of the motor and the reference velocity information compensated by the compensation device when the clutch is engaged.

Such a pressing machine may be used to carry out the aforementioned method of controlling synchronous drive of a plurality of pressing machines according to the present invention in a preferable manner.

According to a fifth aspect of the present invention, it provides a method of controlling synchronous drive of a plurality of pressing machines, each of the pressing machines having a motor, a drive shaft to which a torque of a flywheel driven by the motor is transmitted through a clutch and a slide driven by the drive shaft so that a rotational position of the drive shaft of each of the pressing machines is synchronous each other, the method comprising:

a first step of setting reference velocity information of each of the motors in the pressing machines;

a second step of engaging and de-engaging the clutch of each of the pressing machines;

a third step of transforming a velocity change rate within the reference velocity information set in each of the pressing machines into a first velocity change rate alleviated with a first rate when the clutch is de-engaged, and into a second velocity change rate which is further alleviated from the first velocity change rate with a second rate when the clutch is engaged;

a fourth step of generating reference rotational-position information in each of the pressing machines, based on the reference velocity information having the first or the second velocity change rate;

a fifth step of controlling drive of the motor in each of the pressing machines when the clutch is de-engaged; and a sixth step of controlling drive of the motor in each of the pressing machines when the clutch is engaged, wherein the fifth step carried out in each of the pressing machines comprises the steps of:

detecting actual velocity information of the motor; and controlling drive of the motor, based on the actual velocity information and the reference velocity information having the first velocity change rate, wherein the sixth step carried out in each of the pressing machines comprises the step of:

detecting actual velocity information of the motor;

detecting actual rotational-position information of the drive shaft;

comparing the actual rotational-position information with the reference rotational-position information;

compensating the reference velocity information having the second velocity change rate into characteristic reference velocity information of each of the pressing machines, based on a result of the comparison; and controlling drive of the motor, based on the characteristic reference velocity information and the actual velocity information.

The reference velocity information may be common to the motors in the pressing machines.

In addition to the aforementioned functions, the present invention transforms the velocity change rate in the reference velocity information into the first velocity change rate alleviated by the first rate to use the full torque power of the motor for accelerating/decelerating the flywheel when the clutch is de-engaged and into the second velocity change rate further alleviated from the first velocity change rate when the clutch is engaged. When the clutch is de-engaged, thus, the acceleration/deceleration time, set-up time and waiting time can be reduced by fully using the torque power within the range of motor rating for accelerating/decelerating the flywheel. When the clutch is engaged, on the other hand, the acceleration/deceleration time may be extended to change the velocity during operation while maintaining the function of restoring the release of flywheel energy on each pressing and the accuracy of synchronous control.

When the velocity change rate in the reference velocity information includes an acceleration change rate and a deceleration change rate, each of the first and second rates may be set so that a rate of alleviating the acceleration change rate is higher than a rate of alleviating the deceleration change rate. On the deceleration, the velocity change rate is not required to be alleviated as much as the acceleration since the load on the motor may be used as a braking force.

The aforementioned sixth step may include a step of compensating the reference rotational-position information within a predetermined time period immediately after the clutch of each of the pressing machines is engaged, based on an engagement property of the clutch in one of the pressing machines. Alternatively, the aforementioned sixth step may includes a step of compensating the reference rotational-position information within a predetermined time period immediately after the clutch of each of the pressing machines is engaged, based on an engagement property of the clutch, which is characteristic of each of the pressing machines. Thus, the position of the drive shaft can smoothly be controlled immediately after the clutch-on.

According to a sixth aspect of the present invention, it provides a pressing machine comprising:

a motor;

a clutch which intermittently transmits a torque of a flywheel driven by the motor to the pressing machine;

a drive shaft which drives a slide by a power transmitted through the clutch;

first detection device which detects actual velocity information of the motor;

second detection device which detects actual rotational-position information of the drive shaft;

first generating device which generates reference velocity information of the motor;

velocity-change-rate alleviating device which transforms a velocity change rate in the reference velocity information into a first velocity change rate alleviated by a first rate when the clutch is de-engaged and into a second velocity change rate further alleviated from the first velocity change rate by a second rate when the clutch is engaged;

second generating device which generates reference rotational-position information of the drive shaft, based on the reference velocity information having the first or the second velocity change rate;

compensation device which compensates the reference velocity information having the second velocity change rate at a time of engagement of the clutch, based on a difference between the actual rotational-position information and the reference rotational-position information; and a motor drive controlling circuit which controls drive of the motor, based on the actual velocity information and the reference velocity information having the first velocity change rate when the clutch is de-engaged, and based on the actual velocity information and the reference velocity information compensated by the compensation device when the clutch is engaged.

Such a pressing machine may be used to carry out the aforementioned method of controlling synchronous drive of a plurality of pressing machines in a preferable manner.

Even in such a pressing machine, each of the first and the second rates may be set so that a rate of alleviating the acceleration change rate is higher than a rate of alleviating the deceleration change rate .

DESCRIPTION OF THE PREFERRED EMBODIMENTS

Several embodiments of the present invention will now be described with reference to the drawings.

<First Embodiment>

Structure of Main Pressing Machine Body

Figure 1:
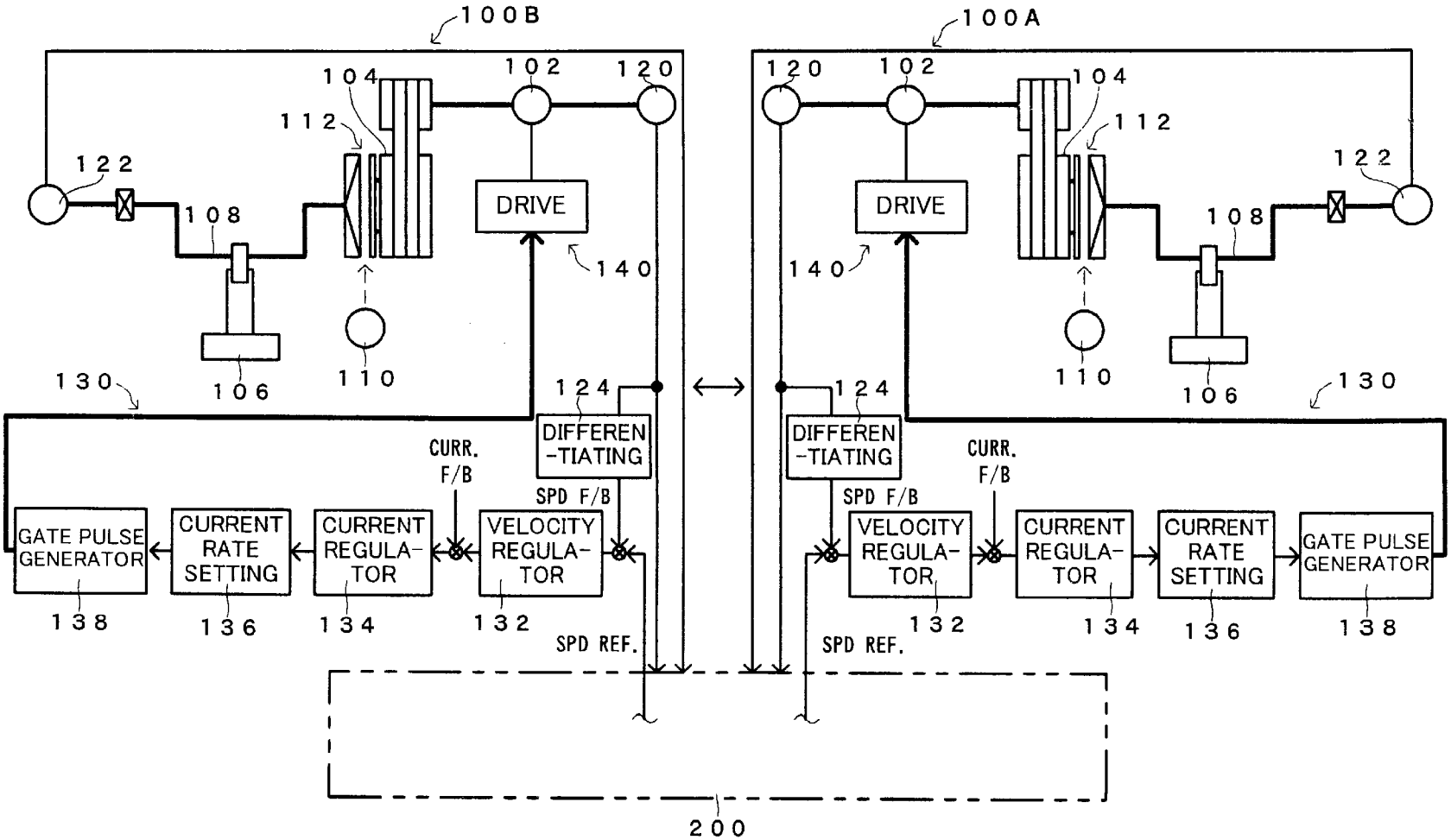
FIG. 1 is a schematic illustration of a press system constructed according to a first embodiment of the present invention.

FIG. 1 shows first and second pressing machines 100A, 100B which are synchronously driven, and a peripheral device 200 for controlling the synchronous drive of the pressing machines. In the first embodiment, two pressing machines 100A and 100B are synchronously driven, but the present invention may similarly be applied to the synchronous control of three or more pressing machines. In the peripheral device 200 in FIG. 1, the synchronous control may be carried out in either of software or hardware.

The first pressing machines 100A may be combined to the peripheral device 200 as a pressing machine set. In such a case, such a pressing machine set (100A and 200) will functions as a master machine while the second pressing machine 100B functions as a slave machine. Thus, the synchronous control may be realized in a master/slave manner.

The first and second pressing machines 100A, 100B shown in FIG. 1 are similar in structure to each other. Each of the first and second pressing machines 100A, 100B has a motor 102 such as a direct-current motor 102 and a flywheel 104 to which the driving force of the motor 102 is transmitted. Each of the first and second pressing machines 100A, 100B also has a crankshaft 108 functioning as a drive shaft for driving a slide 106. The torque of the flywheel 104 is transmitted to the crankshaft 108 through a clutch 112 which is placed in its engaged (ON) or de-engaged (OFF) state by an electromagnetic valve 110. Even though the motor 102 is rotated, therefore, the slide 106 is not vertically moved unless the clutch 112 is in its ON state. The drive sources for the first and second pressing machines 100A, 100B is not limited to the direct-current motors, but may be of any other type such as an inverter motor, a servo-motor or the like.

Each of the first and second pressing machines 100A, 100B further has a first encoder 120 for detecting an actual angle of rotation in the motor 102 and a second encoder 122 for detecting an actual angle of rotation in the crankshaft 108. Each of the first and second pressing machines 100A, 100B further comprises a differentiator 124 for time-differentiating the output of the first encoder 120 to calculates an actual angular velocity of rotation in the motor 102. The actual angular velocity of rotation outputted from the differentiator 124 functions as a velocity feedback signal (SPDF/B). This feedback signal is then compared with a velocity reference signal (SPD REF.) which is supplied from the peripheral device 200.

Each of the first and second pressing machines 100A, 100B further comprises a motor drive control circuit 130 for controlling the current driving in the motor 102, based on the velocity feedback signal and velocity reference signal.

The motor drive control circuit 130 includes a velocity regulator 132 which regulates a difference between the velocity feedback signal and the velocity reference signal, a current regulator 134 which regulates the output of the velocity regulator 132 to a current value, a current rate setting section 136 for setting a predetermined rate in the output of the current regulator 134 and a gate pulse generator 138 for generating a gate pulse supplied to a drive circuit 140 of the motor 102 based on the rate.

Operation Mode of Pressing Machines

Figure 2:
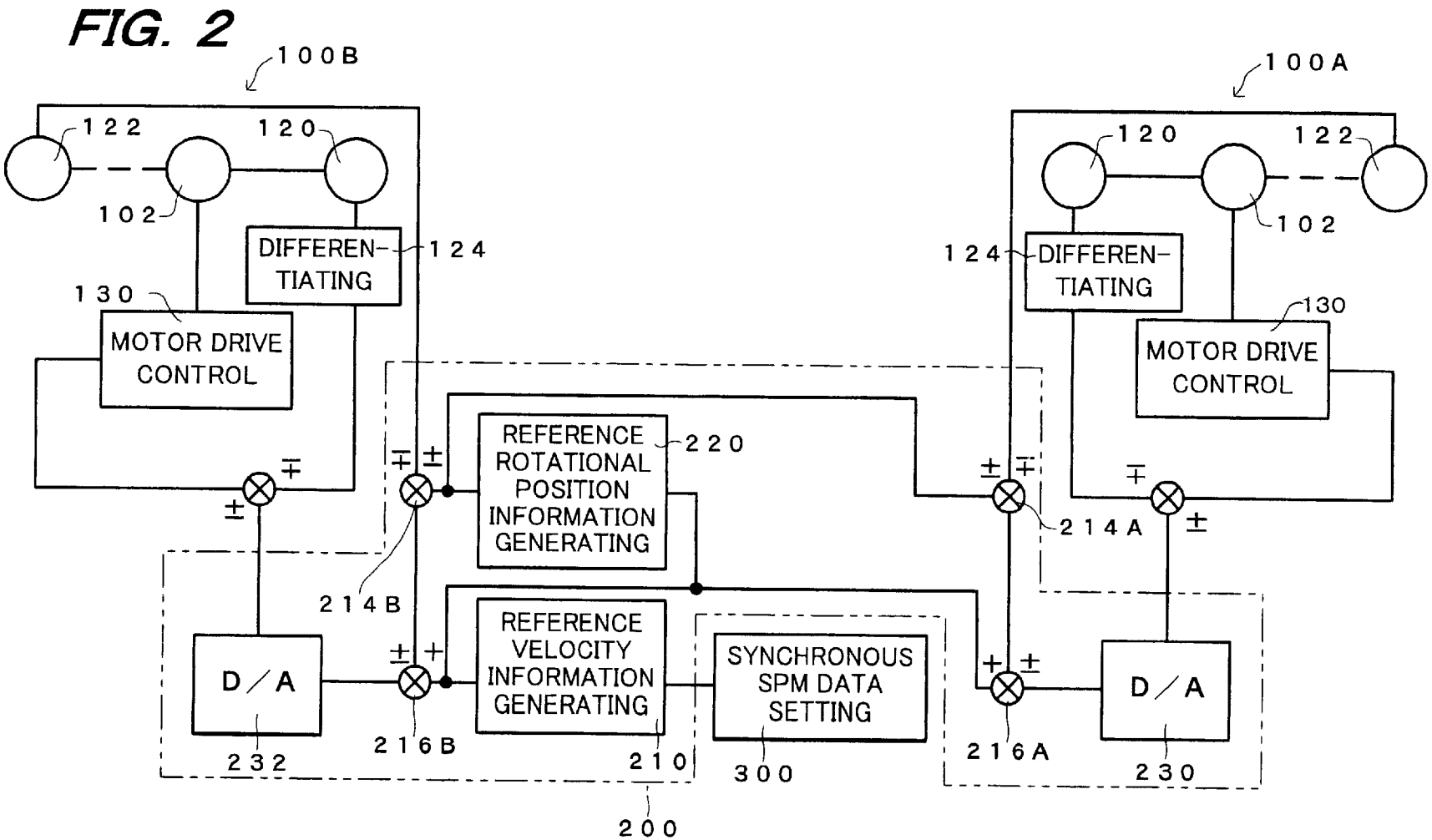
FIG. 2 is a functional block diagram of a peripheral device in each of the pressing machines which is synchronously operated in the system shown in FIG. 1.
Figure 3:
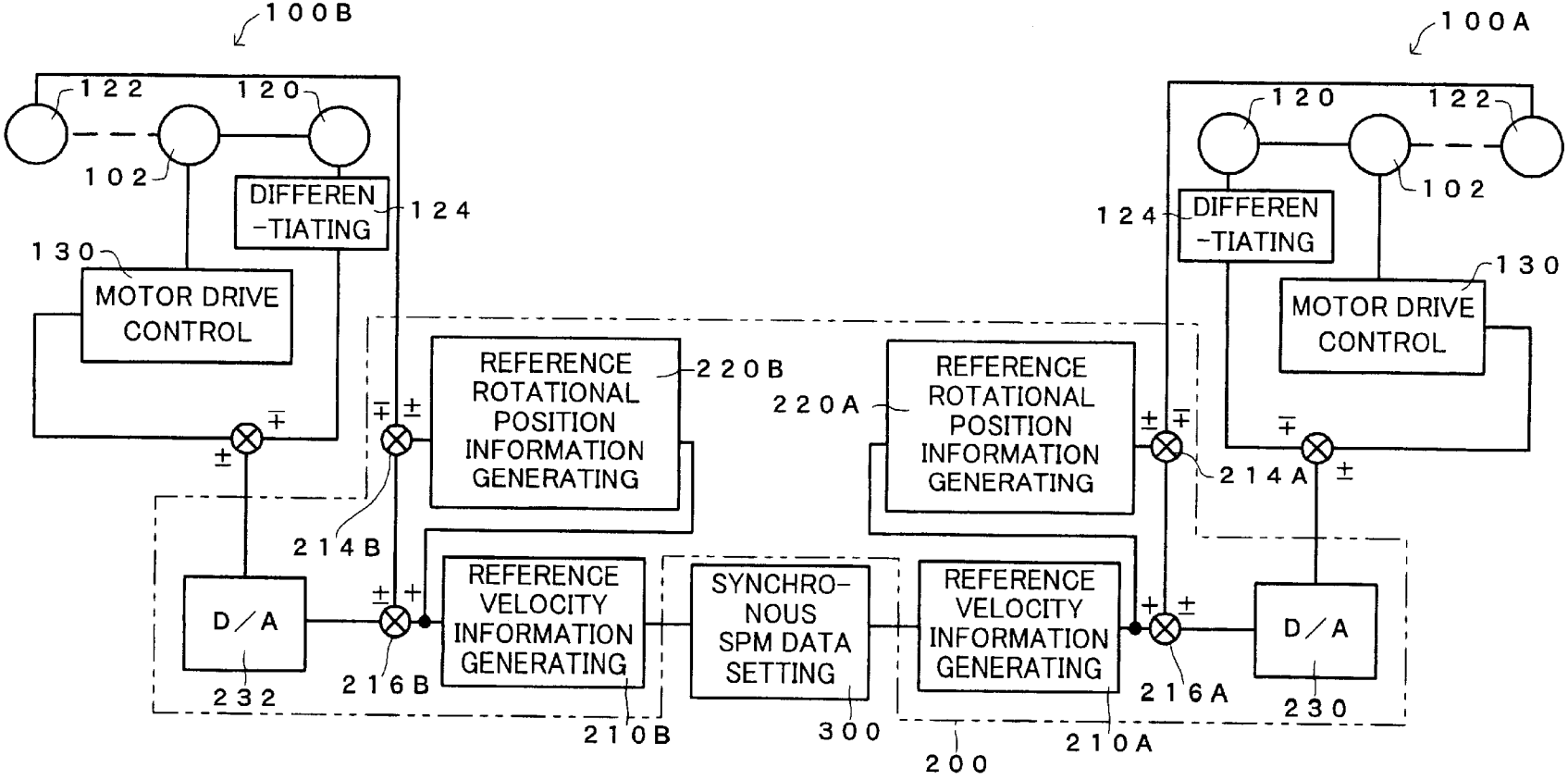
FIG. 3 is a functional block diagram of another peripheral device in each of the pressing machines which is synchronously operated in the system shown in FIG. 1.
Figure 4:
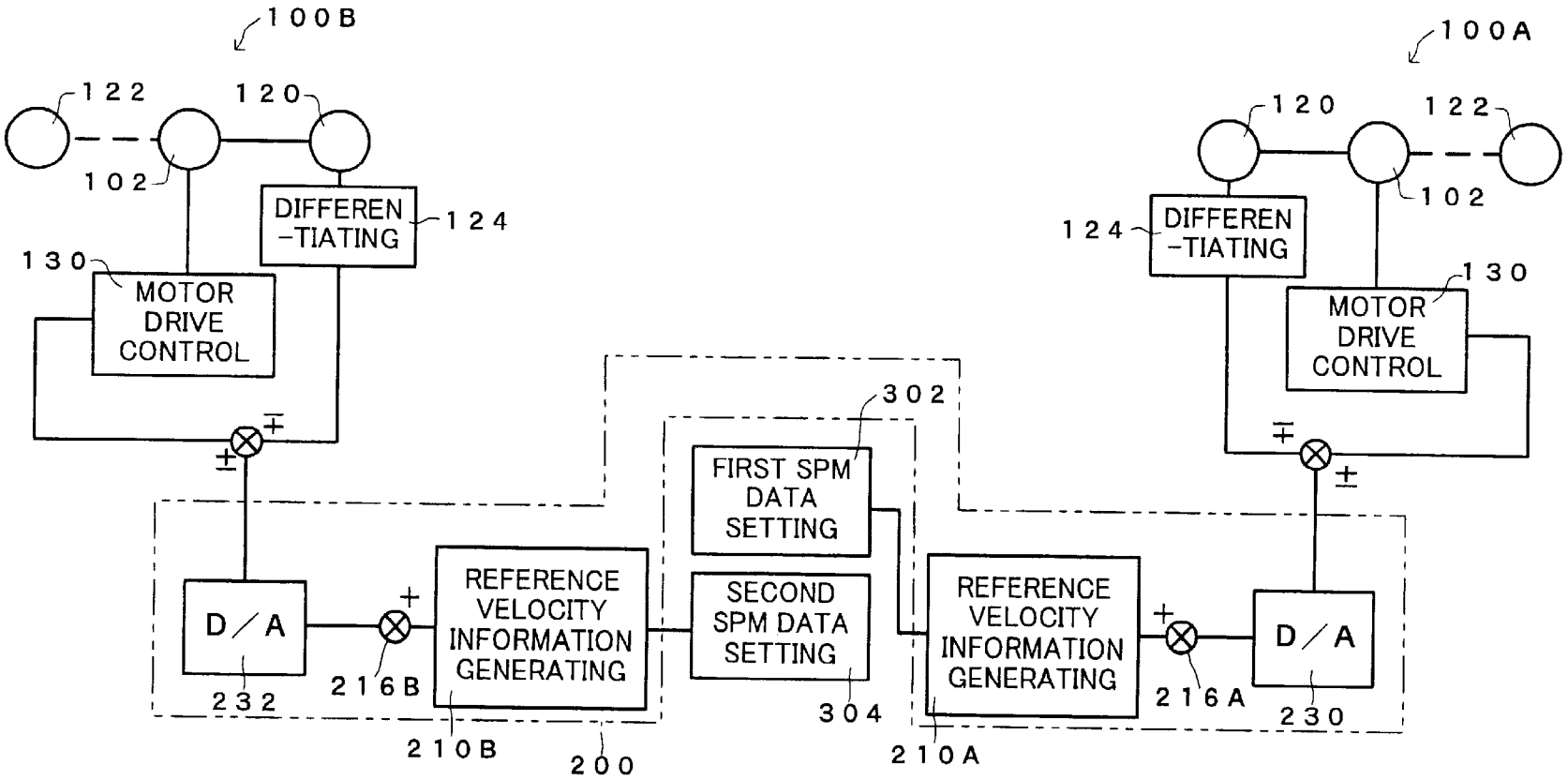
FIG. 4 is a functional block diagram of the peripheral device in each of the pressing machines which is asynchronously operated in the system shown in FIG. 1.

Operation modes which can be carried out in the press system of FIG. 1 include a synchronous operation mode shown in FIGS. 2 and 3 and an independent operation mode shown in FIG. 4. These operation modes are executed through software in the peripheral device 200 shown in FIG. 1.

The synchronous operation mode shown in FIGS. 2 and 3 performs a feedback control of rotational position in the crankshaft 108 in addition to the velocity feedback control for the motor 102 while the independent operation mode shown in FIG. 4 only executes the velocity feedback control for the motor 102.

As shown in FIG. 2, a synchronous SPM (STROKE PER MINUTE) data setting section 300 is provided to synchronously drive the crankshaft 108 in each of the first and second pressing machines 100A, 100B. A reference velocity information generating section 210 commonly provided to the pressing machines 100A and 100B generates reference velocity information of each motor 102, based on the output of this synchronous SPM data setting section 300. Moreover, a reference rotational position information generating section 220 commonly provided to the first and second pressing machines 100A, 100B generates reference rotational-position information of the crankshafts 108.

In the synchronous operation mode shown in FIG. 2, a difference calculator 214A or 21B determines a difference (or error) between rotational-position information of crankshaft from each of the second encoders 122 in the first and second pressing machines 100A, 100B and the reference rotational-position information from the reference rotational position information generating section 220. The difference relating to the rotational position is inputted into each of difference calculators 216A and 216B and the reference velocity information from the reference velocity information generating section 210 is compensated. Thus, the reference velocity information compensated based on the difference of rotational position in the first pressing machine 100A is inputted into the first pressing machines 100A through a digital-to-analog converter 230. Similarly, the reference velocity information compensated based on the difference of rotational position in the second pressing machine 100B is inputted into the second pressing machines 100B through a digital-to-analog converter 232.

In each of the first and second pressing machines 100A, 100B, the motor 102 is controllably driven by the motor drive control circuit 130, based on the difference between the reference velocity information compensated with a compensating value inherent therein and the actual velocity information of each motor.

The reference rotational-position information will not be influenced by the load change in either of the first or second pressing machines 100A or 100B. Thus, this reference rotational-position information is used as an ideal virtual master signal for each of the first and second pressing machines 100A, 100B so that the position of the individual crankshaft 108 is independently controlled in each of the first and second pressing machines 100A, 100B. Consequently, the synchronous control can be carried out with high response and accuracy in each of the first and second pressing machines 100A, 100B.

As shown in FIG. 3, such a synchronous control may similarly be carried out even by providing a reference velocity information generating section 210A and reference rotational position information generating section 220A dedicated to the first pressing machine 100A and by providing a reference velocity information generating section 210B and reference rotational position information generating section 220B dedicated to the second pressing machine 100B.

When the peripheral device 200 having such an arrangement as shown in FIG. 3 is used, the first and second pressing machines 100A, 100B may independently be driven without synchronizing each other, as shown in FIG. 4.

When the independent operation mode is carried out, the control according to the rotational-position information on software will not be carried out. In other words, the control of velocity in the motor 102 of the first pressing machine 100A is carried out so that the reference velocity information generated by the reference velocity information generating section 210A based on the data from the first SPM data setting section 302 is subjected to analog conversion by the digital-to-analog converter 230. The analog-converted reference velocity information and the velocity feedback signal obtained through the first encoder 120 and differentiating circuit 124 are used to perform the controlling drive of the motor 102. The control of velocity in the second pressing machine 100B is also carried out in a manner similar to that of the pressing machine 100A, using the second SPM data setting section, reference velocity information generating section 210B and digital-to-analog converter 232.

Detailed Arrangement of Peripheral Device

Figure 5:
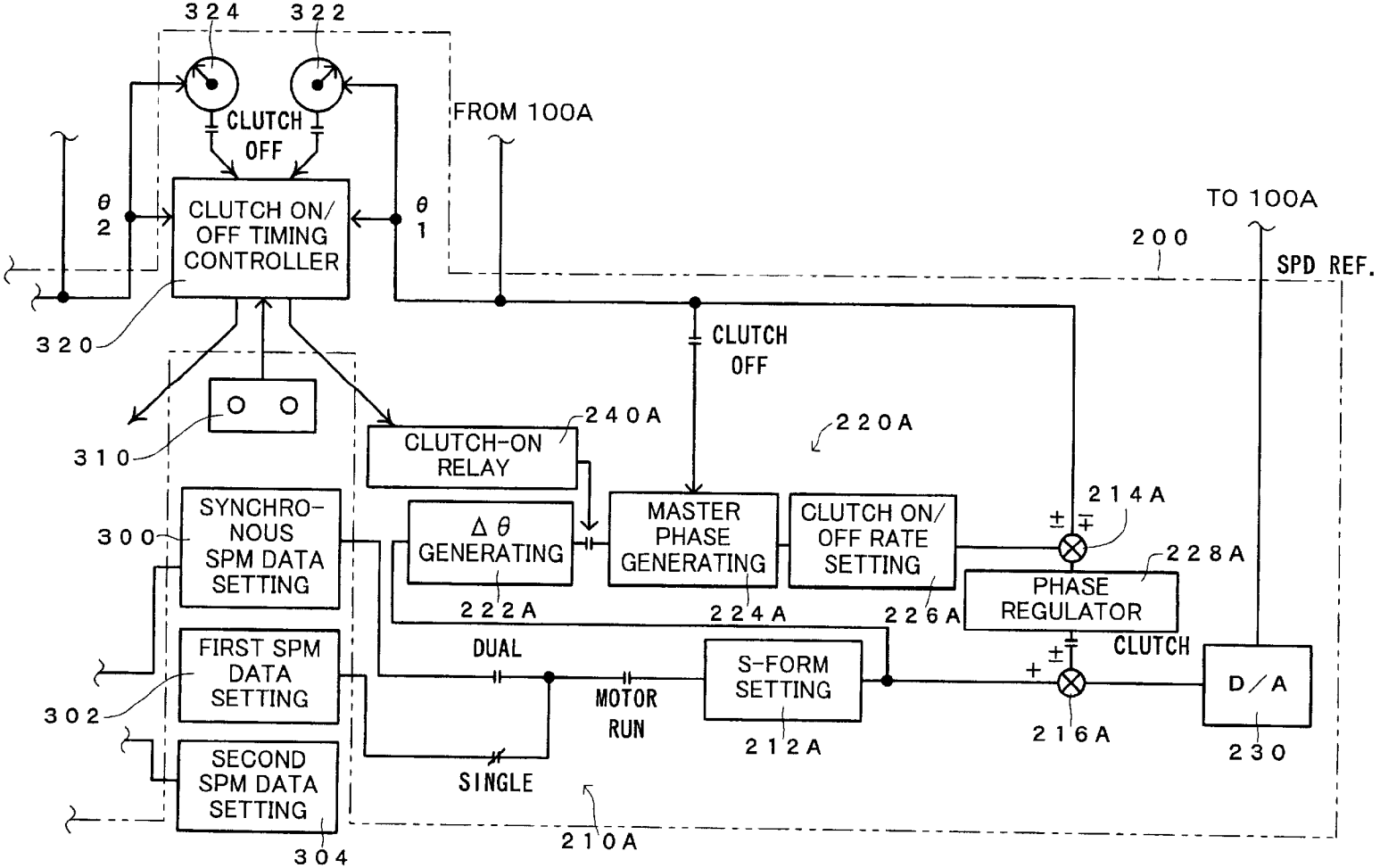
FIG. 5 is a functional block diagram of a peripheral device which can carry out the synchronous operation of FIG. 3 and the asynchronous operation of FIG. 4.

FIG. 5 shows the detailed arrangement of the peripheral device 200 which performs and controls the synchronous operation mode shown in FIG. 3 and the independent operation mode shown in FIG. 4. Sections of FIG. 5 similar to those of FIGS. 3 and 4 are designated by similar reference numerals, and will not further described herein.

FIG. 5 only shows the blocks for the first pressing machine 100A as the structure of the peripheral device 200. Since the second pressing machine 100B includes blocks similar to those of the first pressing machine 100A, they will be omitted for simplicity.

FIG. 5 shows the detailed arrangement of the first pressing machine 100A, which comprises a reference velocity information generating section 210A and a reference rotational position information generating section 220A.

The reference velocity information generating section 210A is configured to use a signal from the synchronous SPM data setting section 300 in the synchronous operation mode (DUAL) and a signal from the first SPM data setting section 302 in the independent operation mode (SINGLE). In these modes, these signals are supplied during driving of the motor 102.

In these operation modes, the signal is inputted into an S-form setting section 212A. When SPM is to be changed during operation of the first pressing machine 100A, for example, the motor cannot follow the stepped change of reference velocity information similar to the stepped change of the reference velocity information, since the first pressing machine 100A has large inertia loads such as flywheel, drive shaft, slide and so on. If the stepped change of reference velocity information is directly applied to the velocity regulator, it causes the overload on the motor and also the mechanical stress against the mechanical drive mechanism which is undesirable.

When the reference velocity information has a rapid change of velocity (including acceleration and deceleration), the S-form setting section 212A alleviates and compensates the velocity change rate so that the motor can effectively be driven without creating overload to provide smoothened acceleration or deceleration.

Figure 6A:
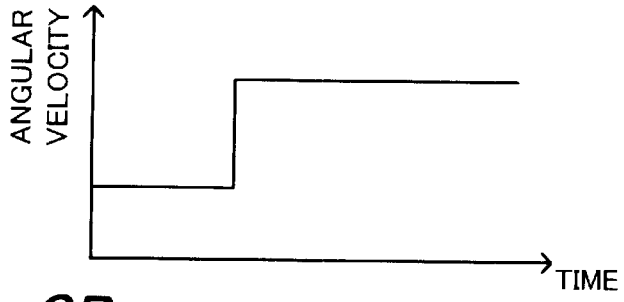
FIGS. 6A and 6B are characteristic graphs illustrating reference velocity information with a velocity change and reference velocity information with the alleviated velocity change.
Figure 6B:
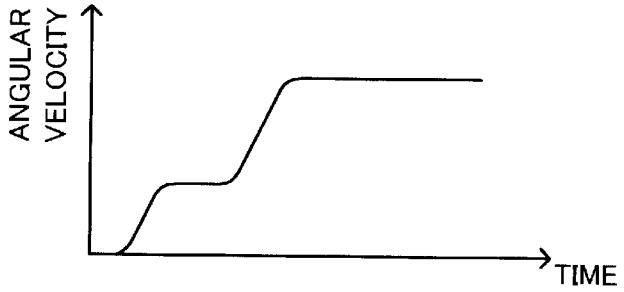

One example of the compensation in the S-form setting section 212A may by utilizing a linear function in view of the characteristics of acceleration and deceleration determined by the motor rating output and mechanical load condition in the first pressing machine 100A and a correction curve function at the corner section. A signal having such a sharp leading edge as shown in FIG. 6A is processed by the linear function and compensated into such a signal as shown in FIG. 6B. The signal shown in FIG. 6B does not sharply change as in FIG. 6A and provides a gentle acceleration. In addition, the S-form setting section 212A can also smoothen a sharp deceleration. For example, this may be applied to deceleration during machining.

Such an S-form setting section 212A may be incorporated into the reference velocity information generating section 210 shown in FIG. 2. In such a case, the reference velocity information generating section 210 may set the S-form in view of the characteristics of acceleration/deceleration in either of the first or second pressing machine 100A or 100B having longer characteristics of acceleration/deceleration since only a single reference velocity information generating section 210 is provided to the plurality of pressing machines 100A and 100B.

The reference rotational position information generating section 220A shown in FIG. 5 includes a $\Delta\theta$ generating section 222A which receives the velocity information from the S-form setting section 212A. The $\Delta\theta$ generating section 222A calculates the velocity information from the S-form setting section 212A according to the rate of deceleration between the mechanical drive mechanism and the motor to determine the transitional amount of rotational position in the drive shaft per cycle time (unit time) in the processing of data at the peripheral device 200. Thus, angle transition information $\Delta\theta$ per unit time will be obtained.

Figure 7:
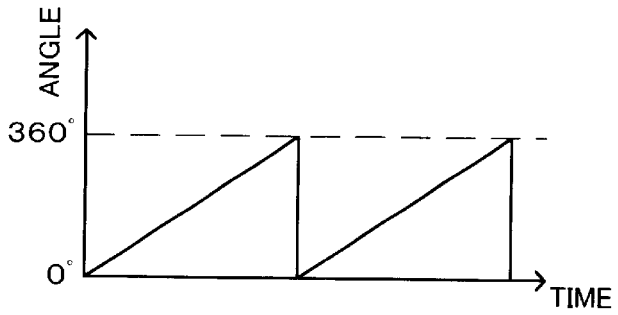
FIG. 7 is a characteristic graph illustrating reference rotational-position information generated by such a master phase generator as shown in FIG. 5.

This angle transition information $\Delta\theta$ is then inputted into a master phase generating section 222A in which the angle transition information $\Delta\theta$ is integrated for unit time and reset for one revolution in the drive shaft 108 (which is the same as the maximum value of the actual rotational-position information). Thus, such a reference rotational-position information of time-to-angle as diagrammatically shown in FIG. 7 can be provided.

Figure 8:
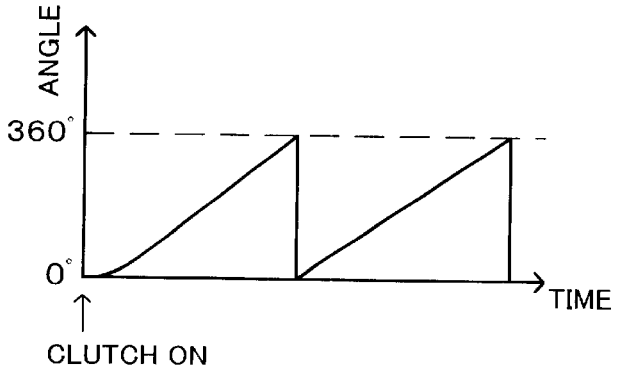
FIG. 8 is a characteristic graph illustrating compensated reference rotational-position information obtained after the reference rotational-position information shown in FIG. 7 has been compensated on clutch engagement.

This reference rotational-position information is then inputted into a clutch on/off rate setting section 226A in which the reference rotational-position information is compensated for the actual property of clutch engagement/de-engagement in the clutch 112 of. the first pressing machine 100A only on clutch on/off. FIG. 8 diagrammatically shows the reference rotational-position information of FIG. 7 compensated according to the clutch engagement property on clutch-on. As will be apparent from FIG. 8, the change of rotational position is smoothened immediately after clutch-on.

Such a clutch on/off rate setting section 226A may be incorporated into the reference rotational position information generating section 220 shown in FIG. 2. In such a case, the reference rotational position information generating section 220 may set the rate in consideration of the clutch engagement property in either of the pressing machines used as a master since only a single reference rotational position information generating section 220 is provided to the pressing machines 100A and 100B.

The difference calculator 214A then detects a difference between the output of the clutch on/off rate setting section 226A and the output of the second encoder 122 of the first pressing machine 100A. The information of the detected difference is thereafter inputted into a phase regulator 228A.

The phase regulator 228A regulates the aforementioned information of the difference with compensation and gain in view of the inertia, electrical characteristics and so on in the first pressing machine 10A. The reference velocity information is then compensated by the difference calculator 216A based on the regulated difference information and supplied to the first pressing machine 100A through the digital-to-analog converter 230 as reference information of velocity (SPD REF.).

When the synchronous drive is controlled by the peripheral device 200 shown in FIG. 5 in such a manner, any difference between the amounts of positional control in the first and second pressing machines 100A, 100B can be minimized through a period from starting the operation of the synchronous control immediately after clutch-on to the acceleration/deceleration during the operation, since the compensation is carried out depending on the engagement property of the clutch or to alleviate the rapid acceleration or deceleration. Consequently, the control of position can be initiated or terminated without overload on the respective motor 102 or without transitional increase of the controlling amount.

When the press system according to the first embodiment is used, it can perform a function equivalent to those of multi-step large-scaled pressing machines only by providing a plurality of relatively small-scaled pressing machines and a single peripheral device 200. Therefore, the investment cost can be not only reduced, but also the flexibility in production can be ensured since the small-sized pressing machines can wholly or partially be operated in the synchronous or asynchronous manner.

Control of Clutch on/off Timing

For the synchronous drive of the first and second pressing machines 100A, 100B, the timing of clutch-on is particularly important. This is because the crankshafts 108 of the first and second pressing machines 100A, 100B have not necessarily been stopped with zero phase difference.

When a press drive button on an operating section 310 shown in FIG. 5 is depressed, a command of clutch engagement is inputted into a clutch on/off timing controller 320 which is connected to θ1 and θ2 memories 322, 324. Each of the θ1 and θ2 memories 322, 324 is to store the output θ1 or θ2 (or the actual rotational-position information of the crankshaft 108) of the second encoder 122 in each of the first and second pressing machines 100A, 100B. The data θ1 and θ2 from these memories 322 and 324 are fetched by the clutch on/off timing controller 320 when the clutches 112 of the first and second pressing machines 100A, 100B are in their OFF state.

When the clutch engagement command is inputted into the controller 320 by operating a control button on the operation section, the controller 320 controls the clutch-on operation based on the result of comparison between the angles θ1 and θ2. For example, when the angle θ is a reference value, if $(\theta 1-\theta 2)>+\theta$, the clutch 112 of the second pressing machine 100B is first engaged and thereafter the clutch 112 of the first pressing machine 100A is engaged. If $(\theta 1-\theta 2)>-\theta$, the clutch 112 of the first pressing machine 100A is first engaged and thereafter the clutch 112 of the second pressing machine 100B is engaged. If $\theta 1=\theta 2$ or $|\theta 1-\theta 2|\leqq+\theta$, the clutches 112 of the first and second pressing machines 100A, 100B are simultaneously engaged.

To engage the clutch 112 of the first pressing machine 100A, the command from the controller 320 drives a clutch-on relay 240A shown in FIG. 5. Thus, the electromagnetic valve 110 is driven to engage the clutch 112. Although not illustrated, a clutch-on relay for engaging the clutch 112 of the second pressing machine 100B is located within the peripheral device 200.

Figure 9:
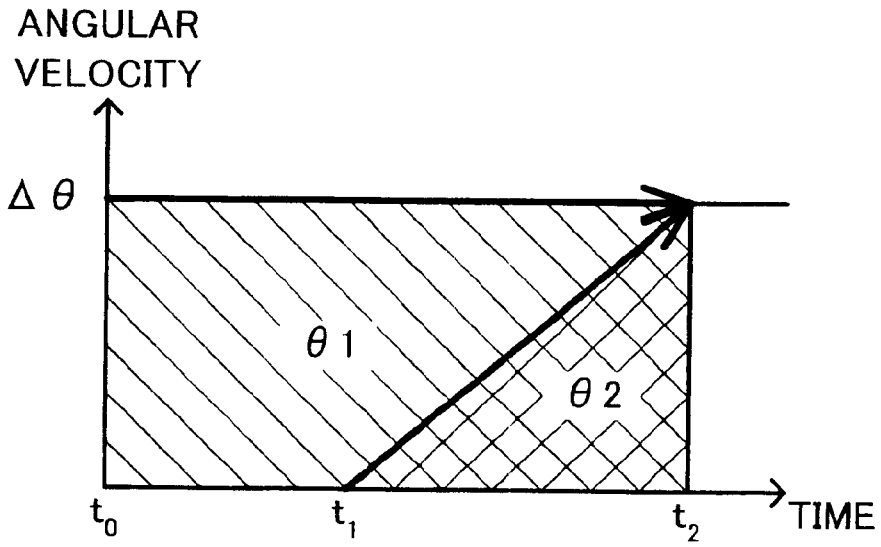
FIG. 9 is a characteristic graph illustrating a clutch-on timing.

For example, if the clutch 112 of the first pressing machine 100A is first engaged, the timing of engaging the clutch 112 of the second pressing machine 100B will be described with reference to FIG. 9. FIG. 9 shows an actual angular velocity Δθ in the crankshaft 108 of the first pressing machine 100A with the clutch thereof being first engaged and it is now assumed that the angular velocity has modulated at a constant rate. Moreover, to illustrate the leading edge of the velocity on the clutch engagement of the pressing machine, a linear function will be used for simplicity. In fact, the reference rotational-position information is compensated by using the function of the velocity leading edge on the pressing machine clutch engagement or its approximate function.

If the initial rotational angle in the crankshaft 108 of the first pressing machine 100A is θ01 at time t0, the angle θ1 of the crankshaft 108 modulated from time t0 to time t2 is as follows.

$$\theta 1=\Delta\theta\ (t2-t1)+\theta 01 \tag{1}$$

The modulated angle shown by this formula (1) corresponds to a hatched square area shown in FIG. 9.

On the other hand, the second pressing machine 100B is commanded to engage its clutch at time t0 whereat the initial rotational angle of the crankshaft 108 is θ02. The clutch 112 is engaged at time t1 and thus the angle θ2 of the crankshaft 108 modulated from time t1 to time t2 is as follows.

$$\theta 2=\Delta\theta(t2-t1)/2+\theta 02 \tag{2}$$

The modulated angle shown by the formula (2) corresponds to a cross-hatched triangular area shown in FIG. 9.

To synchronize the crankshafts 108 of the first and second pressing machines 100A, 100B at time t2, θ1 must be equal to θ2. Therefore, from the formula (1)=the formula (2), following formula will be lead.

$$\Delta\theta(t2-t1)+\theta 01=\Delta\theta(t2-t1)/2+\theta 02 \tag{3}$$

Modifying the formula (3), the angle θ01 in the crankshaft 108 of the first pressing machine 100A when the control of clutch in the second pressing machine 100B is started is as follows.

$$\theta 01=-\Delta\theta(2t0+t1+t2)/2+\theta 02 \tag{4}$$

It is now assumed that t0=0 and θ02=0, and following formula will be lead.

$$\theta 01=-\Delta\theta(t1+t2)/2 \tag{5}$$

Figure 10:
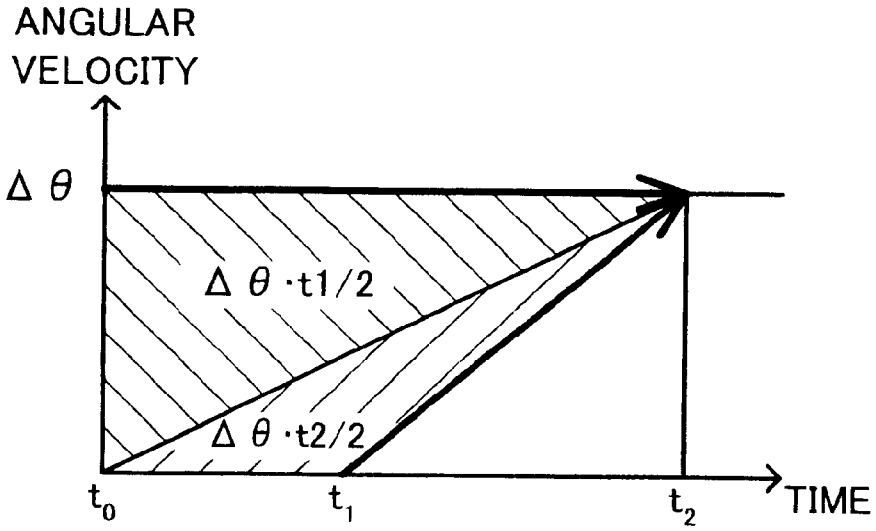
FIG. 10 is a characteristic graph illustrating an angle at which the control of clutch-on is initiated.

The angle shown by the formula (5) corresponds to a trapezoidal area formed of two hatched triangular areas shown in FIG. 10.

The formula (5) means that the first and second pressing machines 100A, 100B can be synchronized at time t2 by starting control of clutch-on in the second pressing machine 100B when the crankshaft 108 of the first pressing machine 100A reaches an angular position backwardly spaced from the stoppage angle of the crankshaft 108 of the second pressing machine 100B by an absolute value of the angle 001 shown by the formula (5).

Considering the characteristic of the actual clutch engagement in the pressing machine with the clutch thereof being later engaged, thus, the synchronous control can be initiated with zero phase difference.

The timing of clutch-off in each of the pressing machines may be controlled considering the characteristic of clutch de-engagement in each of the pressing machines 100A or 100B.

<Second Embodiment>

Pressing Machines and Transporting Robots

Figure 11:
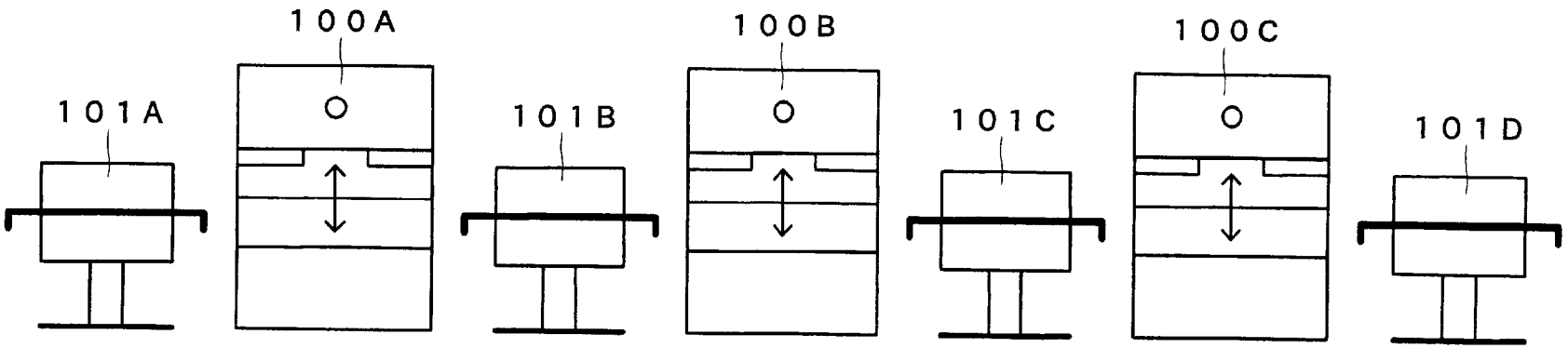
FIG. 11 is a schematic view illustrating a plurality of pressing machines synchronously driven with phase differences and transporting robots used for transporting materials between the pressing machines.

Referring to FIG. 11, there will be described the second embodiment of the present invention in which it comprises a plurality of, for example three (first, second and third), pressing machines 100A, 100B, 100C being synchronously driven with a phase difference and first to fourth transporting robots 101A, 101B, 101C and 101D for transporting materials between the pressing machines.

It is now assumed herein that the first pressing machine 100A is in the first pressing step; the second pressing machine 100B is in the second pressing step succeeding the first pressing step; and the third pressing machine 100C is in the third pressing step succeeding the second pressing step.

The first transporting robot 101A supplies materials to be pressed into the first pressing machine 100A. The second transporting robot 1001B removes the pressed material from the first pressing machine 100A and feeds them into the second pressing machine 100B. The third transporting robot 101C removes the processed materials from the second pressing machine 100B and feeds them into the third pressing machine 100C. The fourth transporting robot 101D removes the processed material from the third pressing machine 100C.

Thus, the second and third transporting robots 101B, 101C must perform two different operations, that is, material removing and feeding operations. For example, if the first and second pressing machines 100A, 100B are synchronously operated with zero phase difference at this time, the materials removed from the first pressing machine 100A must be fed into the second pressing machine 100B while the pressing dies in the first and second pressing machines 100A, 100B are in their open state. If the operation of the second transporting robot has not completed within such a short cycle time, the cycle time in the second transporting robot 100B must be prolonged by once de-engaging the clutches of the first and second pressing machines 100A, 100B to stop the pressing dies thereof at their top dead centers each time when the pressing dies are opened. This is same to the third transporting robot 101C.

However, such a procedure disables the continuous drive of the first to third pressing machines 100A to 100C, resulting in reduction of the working efficiency and also the throughput.

In the second embodiment, the first-to third pressing machines 100A to 100C are synchronously driven with the respective phase differences therebetween. For example, the cycle time in the second transporting robot 101B may be prolonged if the phase difference between the first and second pressing machines 100A, 100B is used so that the pressing dies in the second pressing machine 100B are opened later than those of the first pressing machine 100A. Thus, the cycle time of the transporting robot may be extended by synchronously driving the first to third pressing machines 100A to 100C with the phase differences therebetween while continuously driving them.

Detailed Arrangement of Peripheral Device

Figure 12:
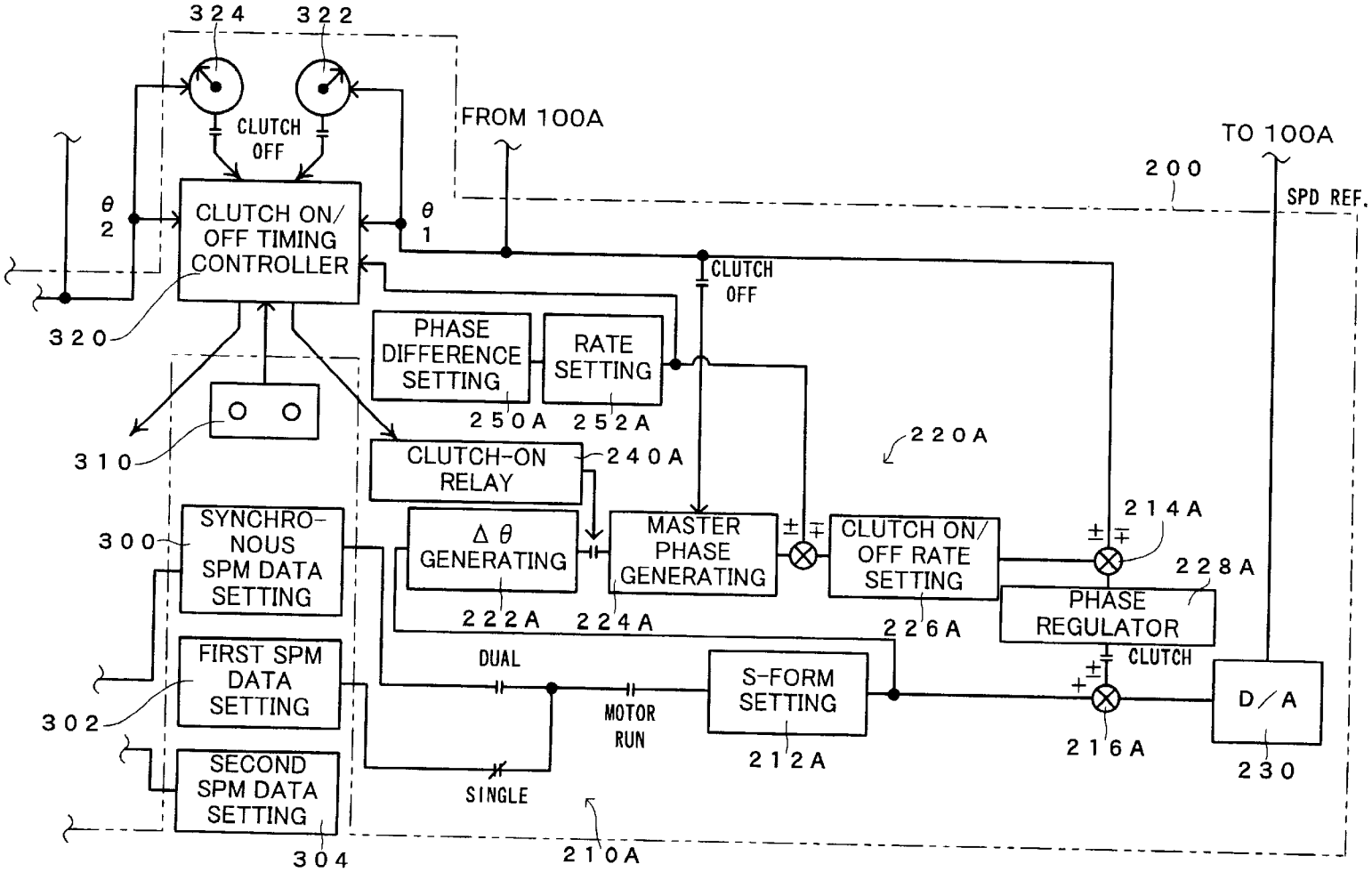
FIG. 12 is a functional block diagram of a peripheral device according to second and third embodiments of the present invention, which can perform the synchronous operation shown in FIG. 3 with phase differences.

FIG. 12 shows a reference rotational position information generating section 220A having its arrangement different from that of FIG. 5. This generating section 220A is designed to set a predetermined phase difference relative to the reference rotational-position information. Namely, the peripheral device 200 comprises a phase difference setting section 250A and a rate setting section 252A.

If it is assumed herein that the phase of an imaginary crankshaft 108 defined by the reference rotational-position information is zero, the phase difference may be set, for example, at a range of −90° to +90°, by the phase difference setting section 250A. The rate setting section 252A is to set a rate for gently causing the phase difference set by the phase difference setting section 250A to change. This enables the phase difference to change during the pressing process without overload on the motors.

Figure 13:
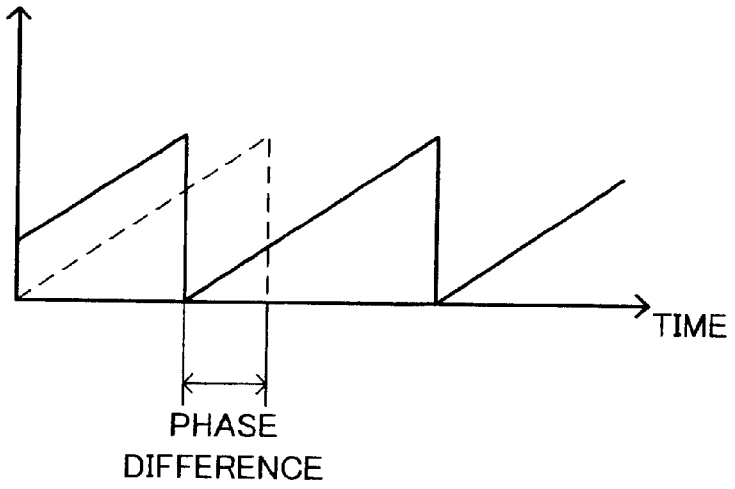
FIG. 13 is a characteristic graph illustrating the reference rotational-position information shown in FIG. 7 after it has been phase-shifted.

When the phase difference is set by the phase difference setting section 250A, the reference rotational-position information is phase-shifted by the output stage of the master generating section 224 according to the phase rate from the rate setting section 252A. For example, the reference rotational-position information shown in FIG. 7 may be phase-shifted as shown in FIG. 13.

Figure 14:
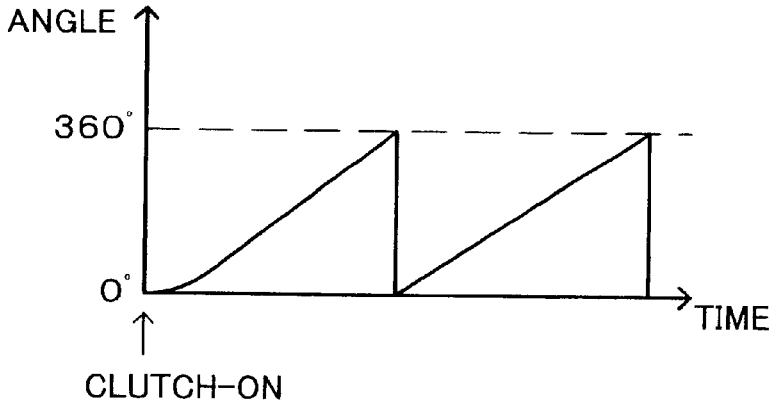
FIG. 14 is a characteristic graph illustrating the reference rotational-position information shown in FIG. 7 after it has been compensated on clutch engagement.

The reference rotational-position information is inputted into the clutch on/off rate setting section 226A in which the reference rotational-position information is compensated to the actual characteristic of clutch engagement/de-engagement in the clutch 112 of the first pressing machine 100A only when the clutch is in on state or in off state. FIG. 14 diagrammatically shows the reference rotational-position information of FIG. 7 after it has been compensated according to the characteristic of clutch engagement when the clutch is engaged. As will be apparent from FIG. 14, the change in the rotational position is smoothened immediately after the clutch engagement.

The clutch on/off rate setting section 226A may be incorporated into the reference rotational position information generating section 220 shown in FIG. 2. In this case, the rate may be set in view of the clutch engagement property of a pressing machine to be the master machine since the reference rotational position information generating section 220 is provided only to one of the pressing machines.

According to the second embodiment, the motors 102 are controllably driven by generating the reference rotational-position information which is not affected by the load variations of the pressing machines and phase-shifting it if necessary and using a difference between the phase-shifted reference rotational-position information and the actual rotational-position information. Thus, if the first pressing machine 100A is driven while maintaining zero phase-shift and the second pressing machine 100B has its set phase-shift, the first and second pressing machines 100A, 100B may synchronously be driven with a predetermined phase difference. If different phase-shifts are respectively set for the first and second pressing machines 100A, 100B, they can synchronously be driven with a predetermined phase difference.

If the synchronous drive is controlled by the peripheral device 200 shown in FIG. 12, the difference of positional control between the first and second pressing machines 100A, 100B may be minimized through the period from the start of synchronous drive immediately after clutch engagement to the acceleration/deceleration during driving, since the compensations are being performed depending on the clutch engagement property or to alleviate the rapid acceleration/deceleration as in FIG. 5. The position control can smoothly be initiated or terminated without overload on the motors 102 or without transitional increase of control.

When the press system according to the second embodiment is used, it may perform the same functions as in multi-step large-scaled pressing machines merely by arranging a plurality of relatively small-sized pressing machines and a single peripheral device 200. Therefore, the investment cost can be not only reduced, but also the flexibility in production can be ensured since the small-sized pressing machines can wholly or partially be operated in the synchronous or asynchronous manner.

Control of Clutch on/off Timing

The second embodiment is different from the first embodiment in that the phase difference set by the phase difference setting section 250A is taken in by the clutch on/off timing controller 320 through the rate setting section 252A.

When the operation button on the operating section 310 is operated to input a clutch-engagement command into the controller 320, the controller controls the clutch-on operation based on the result of comparison between the angles $\theta 1$ and $\theta 2$ and a phase difference set between the angle $\theta 1$ and $\theta 2$. For example, if it is assumed that a reference angle is $\theta$ and the phase difference is a and when $\theta 1-(\theta 2-\alpha)>\theta$, the clutch 112 in the second pressing machine 100B is first engaged and thereafter the clutch 112 of the first pressing machine 100A is engaged. When $\theta 1-(\theta 2-\alpha)<-\theta$, the clutch 112 of the first pressing machine 100B is first engaged and thereafter the clutch 112 of the second pressing machine 100A is engaged. When $|\theta 1-(\theta 2-\alpha)\leqq -\theta$, the clutches 112 in both the first and second pressing machines 100A, 100B are simultaneously engaged.

<Third Embodiment>

The third embodiment includes the functional modification of the S-form setting section 212A shown in FIG. 5 or 12.

For example, the S-form setting section 212A may perform the compensation using a linear function considering the acceleration/deceleration property determined according to the motor rating output and mechanical load condition in the first pressing machine 100A as well as a compensation curve function at the corner section. A signal including such an acceleration as shown in FIG. 15A or a deceleration as shown in FIG. 16A is processed by the linear function with the velocity change rate being alleviated.

Figure 15A:
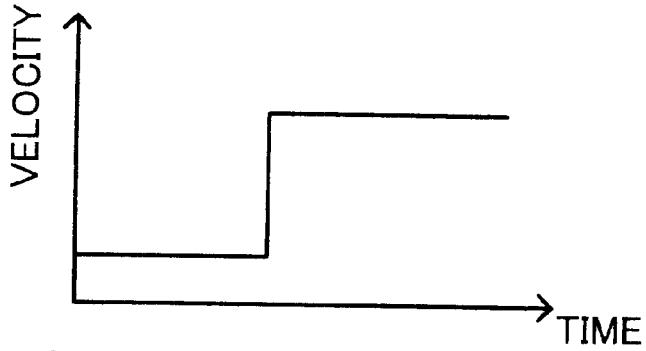
FIGS. 15A to 15C are characteristic graphs illustrating reference velocity information having a velocity change on acceleration and the reference velocity information after the velocity change thereof has been alleviated.
Figure 15B:
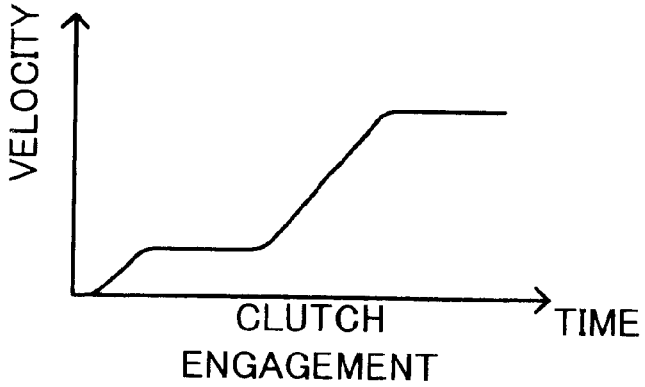
Figure 15C:
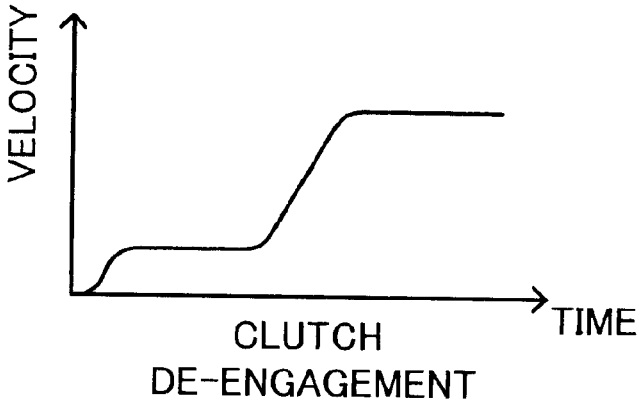
Figure 16A:
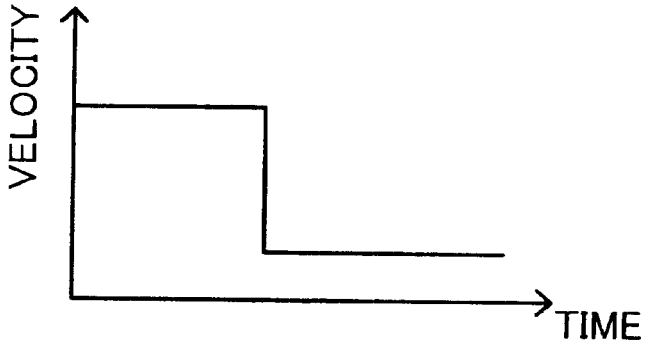
FIGS. 16A to 16C are characteristic graphs illustrating reference velocity information having a velocity change on deceleration and the reference velocity information after the velocity change thereof has been alleviated.

FIG. 15B shows a signal when the clutch is engaged and after the velocity change rate of the signal of FIG. 15A on acceleration has been alleviated while FIG. 15C shows a signal when the clutch is de-engaged and after the velocity change rate of the signal of FIG. 15A has been alleviated. As will be apparent from the comparison of FIGS. 15B and C, the velocity change rate of the signal shown in FIG. 15A is more alleviated in the velocity change rate of FIG. 15B when the clutch is engaged, than the velocity change rate of FIG. 15C when the clutch is de-engaged.

This is because the acceleration/deceleration time is reduced for fully using the torque;power of the motor 102 to accelerate or decelerate the flywheel 104 when the clutch is de-engaged. Thus, the set-up and waiting times on de-engagement of the clutch can be reduced. On the other hand, when the clutch is engaged, the energy is released from the flywheel 104 each time when the pressing step is carried out. The released energy should be restored by the torque power of the motor 102. Since a portion of the torque power of the motor 102 is depleted as in de-engagement of the clutch, thus, the acceleration/deceleration time is set longer when the clutch is engaged, rather than when the clutch is de-engaged. This enables the driving velocity to be changed in the engagement of the clutch while maintaining the restoring operation of energy after the energy has been released from the flywheel each time when the pressing operation is carried out as well as the accuracy of synchronous control. In the prior art, when the velocity is changed, the clutch-off state must be maintained until the acceleration or deceleration of the flywheel 104 is terminated with the velocity reaching a constant level. However, the third embodiment does not require such a procedure and can enlarge the degree of freedom in the driving process.

Figure 16B:
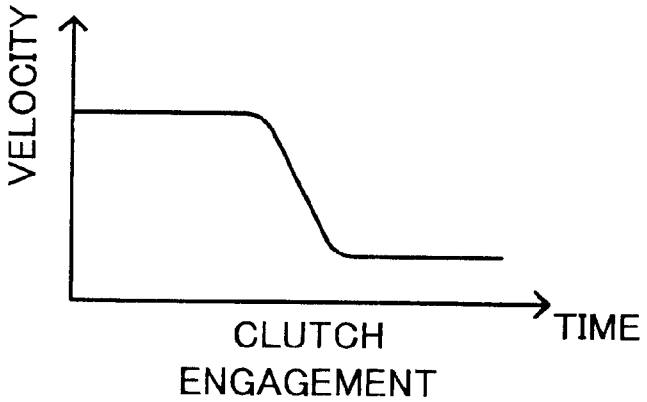

As shown in FIGS. 16B and C, this is same to alleviating the velocity change rate on deceleration. Namely, the velocity change rate of the signal shown in FIG. 16A is more alleviated in the velocity change rate of FIG. 16B when the clutch is engaged, than the velocity change rate of FIG. 16C when the clutch is de-engaged.

Figure 16C:
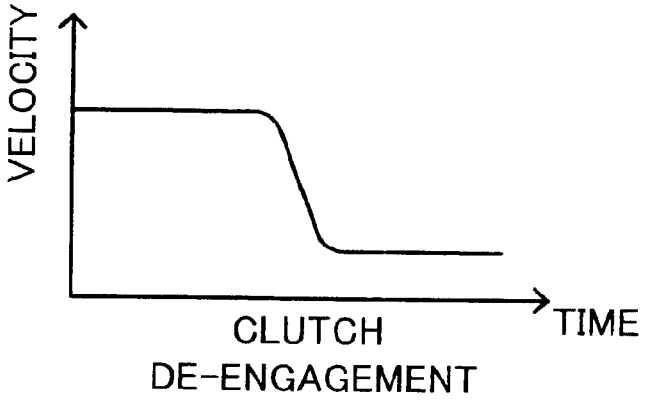

As will be apparent from the comparisons between FIGS. 15B and 16B and between FIGS. 15C and 16C, the velocity change rate on acceleration is more alleviated from that on deceleration. This is because the deceleration does not require the alleviation of velocity change rate unlike the acceleration since the load on the motor in the deceleration can be used as a braking power.

By utilizing such a control procedure, the acceleration/deceleration time in the flywheel 104 can be reduced as in the set-up step in which the clutch 112 is state. In addition, the torque of the motor required to perform the acceleration or deceleration can be minimized when the clutch 112 is engaged to perform the synchronous drive. In such a manner, the synchronous control can more rapidly be responded with improved accuracy even during the acceleration/deceleration.

The S-form setting section 212A may be incorporated into the reference velocity information generating section 210 shown in FIG. 2. In this case, the S-form may be set considering the characteristic of acceleration/deceleration in any pressing machine having the longer characteristic of acceleration/deceleration since only a single reference velocity information generating section 210 is provided to a plurality of pressing machines.

What is claimed is:

1. A method of controlling synchronous drive of a plurality of pressing machines, each of the pressing machines having a motor, a drive shaft to which a torque of a flywheel driven by the motor is transmitted through a clutch and a slide driven by the drive shaft so that a rotational position of the drive shaft of each of the pressing machines is synchronous each other, the method comprising:

a first step of setting reference velocity information of each of the motors in the pressing machines;

a second step of generating reference rotational-position information of each of the drive shafts, based on the reference velocity information;

a third step of engaging the clutch of each of the pressing machines; and a fourth step of controlling drive of the motor in each of the pressing machines, wherein the fourth step carried out in each of the pressing machines comprising the steps of:

detecting actual velocity information of the motor;

detecting actual rotational-position information of the drive shaft;

comparing the actual rotational-position information with the reference rotational-position information;

compensating the reference velocity information into characteristic reference velocity information of each of the pressing machines, based on a result of the comparison; and controlling drive of the motor, based on the characteristic reference velocity information and the actual velocity information.

2. The method according to claim 1, wherein the reference velocity information is set in common to the motors of the pressing machines.

3. The method according to claim 1, further comprising a step of compensating a rate of the velocity change so as to alleviate the velocity change rate, when the reference velocity information includes a velocity change.

4. The method according to claim 1, wherein the fourth step further comprises a step of compensating the reference rotational-position information within a predetermined time period immediately after the clutch of each of the pressing machines is engaged, based on an engagement property of the clutch, which is characteristic of each of the pressing machines.

5. The method according to claim 1, wherein the third step further comprises:

a step of detecting stoppage angle information of the drive shaft of each of the pressing machines before the clutch of each of the pressing machines is engaged; and a step of determining an engagement sequence of the clutch of each of the pressing machines, based on the stoppage angle information of the drive shaft of each of the pressing machines, and wherein the engagement sequence is determined so that the clutch of at least one of the pressing machines having a stoppage angle position of the drive shaft which is more delayed in the rotational angle of the drive shaft is engaged earlier.

6. The method according to claim 5, wherein a clutch of one of the pressing machines is engaged earlier than a clutch of another of the pressing machines in the third step, and a timing of clutch engagement of the other of the pressing machines is determined based on an engagement property of the clutch of the other of the pressing machines and an actual velocity of the drive shaft of the one of the pressing machines.

7. The method according to claim 6, wherein in the third step, the timing of clutch engagement in the other of the pressing machines is determined according to information obtained by time integrating the actual velocity, through time required for a velocity equal to the actual velocity of the drive shaft of the one of the pressing machines is obtained by the other of the pressing machines, based on the engagement property of the clutch after the clutch of the other of the pressing machines has been engaged.

8. A pressing machine comprising:

a motor;

a clutch which intermittently transmits a torque of a flywheel driven by the motor to the pressing machine;

a drive shaft which drives a slide by a power transmitted through the clutch;

first detection device which detects actual velocity information of the motor;

second detection device which detects actual rotational-position information of the drive shaft;

first generating device which generates reference velocity information of the motor;

second generating device which generates reference rotational-position information of the drive shaft, based on the reference velocity information;

compensation device which compensates the reference velocity information at a time of engagement of the clutch, based on a difference between the actual rotational-position information and the reference rotational-position information; and a motor drive controlling circuit which controls drive of the motor, based on the actual velocity information and the reference velocity information when the clutch is de-engaged, and based on the actual velocity information and the reference velocity information compensated by the compensation device when the clutch is engaged.

9. The pressing machine according to claim 8, wherein the first generating device includes a first compensation block which compensates so as to alleviate a velocity change rate when the reference velocity information includes the velocity change.

10. The pressing machine according to claim 8, wherein the second generating device includes a second compensation block which compensates the reference rotational-position information within a predetermined time period immediately after the clutch is engaged, based on an engagement property of the clutch.

11. The pressing machine according to claim 8, wherein the second generating device includes:

a first generating block which generates unit-rotational-position information of the drive shaft per predetermined unit time, based on the reference velocity information from the first generating device; and a second generating block which generates reference rotational-position information by integrating the unit-rotational-position information per predetermined time period.

12. A method of controlling synchronous drive of a plurality of pressing machines, each of the pressing machines having a motor, a drive shaft to which a torque output of a flywheel driven by the motor is transmitted through a clutch and a slide driven by the drive shaft so that a rotational position of the drive shaft of each of the pressing machines has phase difference from each other, the method comprising:

a first step of setting reference velocity information of each of the motors in the pressing machines;

a second step of generating reference rotational-position information of each of the drive shafts, based on the reference velocity information;

a third step of setting a phase difference with respect to the reference rotational-position information of at least one of the pressing machines;

a fourth step of engaging the clutch of each of the pressing machines; and a fifth step of controlling drive of the motor in each of the pressing machines, wherein the fifth step carried out in each of the pressing machines comprises the steps of:

detecting actual velocity information of the motor;

detecting actual rotational-position information of the drive shaft;

comparing the actual rotational-position information with the reference rotational-position information;

compensating the reference velocity information into characteristic reference velocity information of each of the pressing machines, based on a result of the comparison; and controlling drive of the motor, based on the characteristic reference velocity information and the actual velocity information, and wherein the fifth step carried out in the at least one of the pressing machines to which the phase difference is set, further comprises a step of phase-shifting the reference rotational-position information by the phase difference set in the third step, and the phase-shifted reference rotational-position information and the actual rotational-position information are compared in the comparing step.

13. The method according to claim 12, wherein the fifth step carried out in the at least one of the pressing machines to which the phase difference is set includes a step of setting a rate of gradually applying the phase difference.

14. The method according to claim 12, wherein the reference velocity information is set in common to the motors of the pressing machines.

15. The method according to claim 12, further comprising a step of compensating a rate of the velocity change so as to alleviate the velocity change rate, when the reference velocity information includes a velocity change.

16. The method according to claim 12, wherein the fifth step further comprises a step of compensating the reference rotational-position information within a predetermined time period immediately after the clutch of each of the pressing machines is engaged, based on an engagement property of the clutch, which is characteristic of each of the pressing machines.

17. The method according to claim 12, wherein the third step further comprises:

a step of detecting stoppage angle information of the drive shaft of each of the pressing machines before the clutch of each of the pressing machines is engaged; and a step of determining an engagement sequence of the clutch of each of the pressing machines, based on the stoppage angle information of the drive shaft of each of the pressing machines and based on the phase difference.

18. The method according to claim 17, wherein a clutch of one of the pressing machines is engaged earlier than a clutch of another of the pressing machines in the third step, and a timing of clutch engagement of the other of the pressing machines is determined based on an engagement property of the clutch of the other of the pressing machines and an actual velocity of the drive shaft of the one of the pressing machines.

19. The method according to claim 18, wherein in the third step, the timing of clutch engagement in the other of the pressing machines is determined according to information obtained by time integrating the actual velocity, through time required for a velocity equal to the actual velocity of the drive shaft of the one of the pressing machines is obtained by the other of the pressing machines, based on the engagement property of the clutch after the clutch of the other of the pressing machines has been engaged.

20. A pressing machine comprising:

a motor;

a clutch which intermittently transmits a torque output of a flywheel driven by the motor to the pressing machine;

a drive shaft which drives a slide by a power transmitted through the clutch;

first detection device which detects actual velocity information of the motor;

second detection device which detects actual rotational-position information of the drive shaft;

first generating device which generates reference velocity information of the motor;

second generating device which generates reference rotational-position information of the drive shaft, based on the reference velocity information;

phase difference setting device which sets a phase difference to the reference velocity information;

compensation device which compensates the reference velocity information at a time of engagement of the clutch, based on a difference between the actual rotational-position information and the reference rotational-position information to which the phase difference is set; and a motor drive controlling circuit which controls drive of the motor, based on the actual velocity information of the motor and the reference velocity information when the clutch is de-engaged, and based on the actual velocity information of the motor and the reference velocity information compensated by the compensation device when the clutch is engaged.

21. The pressing machine according to claim 20, wherein the phase difference setting device sets a rate for gradually applying the phase difference to the reference rotational-position information when the clutch is engaged.

22. The pressing machine according to claim 20, wherein the first generating device includes a first compensation block which compensates so as to alleviate a velocity change rate when the reference velocity information includes the velocity change.

23. The pressing machine according to claim 20, wherein the second generating device includes a second compensation block which compensates the reference rotational-position information within a predetermined time period immediately after the clutch is engaged, based on an engagement property of the clutch.

24. The pressing machine according to claim 20, wherein the second generating device includes:

a first generating block which generates unit-rotational-position information of the drive shaft per predetermined unit time, based on the reference velocity information from the first generating device; and a second generating block which generates reference rotational-position information by integrating the unit-rotational-position information per predetermined time period.

25. A method of controlling synchronous drive of a plurality of pressing machines, each of the pressing machines having a motor, a drive shaft to which a torque of a flywheel driven by the motor is transmitted through a clutch and a slide driven by the drive shaft so that a rotational position of the drive shaft of each of the pressing machines is synchronous each other, the method comprising:

a first step of setting reference velocity information of each of the motors in the pressing machines;

a second step of engaging and de-engaging the clutch of each of the pressing machines;

a third step of transforming a velocity change rate within the reference velocity information set in each of the pressing machines into a first velocity change rate alleviated with a first rate when the clutch is de-engaged, and into a second velocity change rate which is further alleviated from the first velocity change rate with a second rate when the clutch is engaged;

a fourth step of generating reference rotational-position information in each of the pressing machines, based on the reference velocity information having the first or the second velocity change rate;

a fifth step of controlling drive of the motor in each of the pressing machines when the clutch is de-engaged; and a sixth step of controlling drive of the motor in each of the pressing machines when the clutch is engaged, wherein the fifth step carried out in each of the pressing machines comprises the steps of:

detecting actual velocity information of the motor; and controlling drive of the motor, based on the actual velocity information and the reference velocity information having the first velocity change rate, wherein the sixth step carried out in each of the pressing machines comprises the step of:

detecting actual velocity information of the motor;

detecting actual rotational-position information of the drive shaft;

comparing the actual rotational-position information with the reference rotational-position information;

compensating the reference velocity information having the second velocity change rate into characteristic reference velocity information of each of the pressing machines, based on a result of the comparison; and controlling drive of the motor, based on the characteristic reference velocity information and the actual velocity information.

26. The method according to claim 25, wherein the velocity change rate in the reference velocity information includes an acceleration change rate and a deceleration change rate, and wherein each of the first and second rates is set so that a rate of alleviating the acceleration change rate is higher than a rate of alleviating the deceleration change rate.

27. The method according to claim 25, wherein the reference velocity information is set in common to the motors of the pressing machines.

28. The method according to claim 25, wherein the sixth step includes a step of compensating the reference rotational-position information within a predetermined time period immediately after the clutch of each of the pressing machines is engaged, based on an engagement property of the clutch in one of the pressing machines.

29. The method according to claim 25, wherein the sixth step includes a step of compensating the reference rotational-position information within a predetermined time period immediately after the clutch of each of the pressing machines is engaged, based on an engagement property of the clutch, which is characteristic of each of the pressing machines.

30. A pressing machine comprising:

a motor;

a clutch which intermittently transmits a torque of a flywheel driven by the motor to the pressing machine;

a drive shaft which drives a slide by a power transmitted through the clutch;

first detection device which detects actual velocity information of the motor;

second detection device which detects actual rotational-position information of the drive shaft;

first generating device which generates reference velocity information of the motor;

velocity-change-rate alleviating device which transforms a velocity change rate in the reference velocity information into a first velocity change rate alleviated by a first rate when the clutch is de-engaged and into a second velocity change rate further alleviated from the first velocity change rate by a second rate when the clutch is engaged;

second generating device which generates reference rotational-position information of the drive shaft, based on the reference velocity information having the first or the second velocity change rate;

compensation device which compensates the reference velocity information having the second velocity change rate at a time of engagement of the clutch, based on a difference between the actual rotational-position information and the reference rotational-position information; and a motor drive controlling circuit which controls drive of the motor, based on the actual velocity information and the reference velocity information having the first velocity change rate when the clutch is de-engaged, and based on the actual velocity information and the reference velocity information compensated by the compensation device when the clutch is engaged.

31. The pressing machine according to claim 30, wherein the velocity change rate in the reference velocity information includes an acceleration change rate and a deceleration change rate, and wherein each of the first and the second rates is set so that a rate of alleviating the acceleration change rate is higher than a rate of alleviating the deceleration change rate.

32. The pressing machine according to claim 30, wherein the first generating device includes a compensation block which compensates the reference velocity information within a predetermined time period immediately after the clutch is engaged, based on an engagement property of the clutch.

33. The pressing machine according to claim 30, wherein the second generating device includes:

a first generating block which generates unit-rotational-position information of the drive shaft per predetermined unit time, based on the reference velocity information from the first generating device; and a second generating block which generates reference rotational-position information by integrating the unit-rotational-position information per predetermined time period.

* * * * *